US012071952B2

(12) United States Patent
Jiang et al.

(10) Patent No.: US 12,071,952 B2
(45) Date of Patent: Aug. 27, 2024

(54) SCROLL-COMPRESSOR, REFRIGERATION DEVICE, AND VEHICLE WITH OIL SEPARATION AND OIL STORAGE

(71) Applicants: ANHUI WELLING AUTO PARTS CO., LTD., Anhui (CN); GUANGDONG WELLING AUTO PARTS CO., LTD., Guangdong (CN)

(72) Inventors: Guobiao Jiang, Guangdong (CN); Kaicheng Yang, Guangdong (CN); Jiahui Wu, Guangdong (CN); Jianglin Yang, Guangdong (CN); Sheng Zhong, Guangdong (CN)

(73) Assignees: ANHUI WELLING AUTO PARTS CO., LTD., Anhui (CN); GUANGDONG WELLING AUTO PARTS CO., LTD., Guangdong (CN)

( * ) Notice: Subject to any disclaimer, the term of this patent is extended or adjusted under 35 U.S.C. 154(b) by 26 days.

(21) Appl. No.: 17/897,359

(22) Filed: Aug. 29, 2022

(65) Prior Publication Data

US 2022/0412360 A1 Dec. 29, 2022

Related U.S. Application Data

(63) Continuation of application No. PCT/CN2020/119605, filed on Sep. 30, 2020.

(51) Int. Cl.
*F04C 29/02* (2006.01)
*F04C 18/02* (2006.01)
(Continued)

(52) U.S. Cl.
CPC ..... *F04C 29/026* (2013.01); *F04C 18/0215* (2013.01); *F04C 27/008* (2013.01);
(Continued)

(58) Field of Classification Search
CPC .. F04C 29/026; F04C 18/0215; F04C 27/008; F04C 29/028; F04C 29/12; F04C 2240/30; F04C 2240/809
See application file for complete search history.

(56) References Cited

U.S. PATENT DOCUMENTS 5,499,515 A 3/1996 Kawamura et al.
2020/0300245 A1* 9/2020 Park ..... F04C 18/0215

FOREIGN PATENT DOCUMENTS

CN 103321909 A 9/2013
CN 104912797 A 9/2015
(Continued)

OTHER PUBLICATIONS

International Search Report dated Jun. 22, 2021 received in International Application No. PCT/CN2020/119605.
(Continued)

*Primary Examiner* — Mary Davis
(74) *Attorney, Agent, or Firm* — Scully, Scott, Murphy & Presser, P.C.

(57) ABSTRACT

Provided are a scroll compressor, a refrigeration device, and a vehicle. In the scroll compressor, an oil discharging hole of an oil separation structure and an oil storage tank are connected to each other by an oil outlet channel disposed in a housing, and an oil outlet of the oil outlet channel is located above an oil inlet. The oil outlet channel can guide a refrigeration oil discharged from the oil discharging hole to flow into the oil storage tank. After passing through the oil outlet channel, a flow rate and a pressure of the refrigeration oil decrease, and thus an impact of the refrigeration oil on the remaining refrigeration oil in the oil storage tank is reduced when discharged from the oil outlet. Therefore, the
(Continued)

refrigeration oil within the oil storage tank remains stable and can always immerse an oil return hole of the oil storage tank.

18 Claims, 9 Drawing Sheets

(51) Int. Cl.
*F04C 27/00* (2006.01)
*F04C 29/12* (2006.01)

(52) U.S. Cl.
CPC ..... *F04C 29/028* (2013.01); *F04C 29/12* (2013.01); *F04C 2240/30* (2013.01); *F04C 2240/809* (2013.01)

(56) References Cited

FOREIGN PATENT DOCUMENTS

| | | | | |
|---|---|---|---|---|
| CN | 110966185 | A | 4/2020 | |
| DE | 69823117 | T2 * | 4/2005 | ..... F04C 18/0215 |
| EP | 2554849 | A2 | 2/2013 | |
| EP | 2642128 | A2 | 9/2013 | |
| EP | 2642128 | A3 | 11/2013 | |
| EP | 2554849 | A3 | 3/2017 | |
| JP | 2006249992 | A | 9/2006 | |
| JP | 2013036341 | A | 2/2013 | |
| JP | 2013199855 | A | 10/2013 | |
| JP | 2015175280 | A | 10/2015 | |
| JP | 2016109065 | A | 6/2016 | |
| JP | 2016109066 | A | 6/2016 | |
| JP | 2017172426 | A | 9/2017 | |
| WO | 2016157445 | A1 | 10/2016 | |
| WO | 2018146991 | A1 | 8/2018 | |

OTHER PUBLICATIONS

Notice of Reasons for Refusal dated Jul. 25, 2023 received in Japanese Patent Application No. JP 2022-542447.

Decision to Grant a Patent dated Oct. 7, 2023 received in Japanese Patent Application No. JP 2022-542447.

Extended European Search Report dated May 16, 2023 received in European Patent Application No. EP 20955765.1.

* cited by examiner

-Prior Art-

SCROLL-COMPRESSOR, REFRIGERATION DEVICE, AND VEHICLE WITH OIL SEPARATION AND OIL STORAGE

CROSS-REFERENCE TO RELATED APPLICATION

This application is a continuation application of PCT International Application No. PCT/CN2020/119605, filed on Sep. 30, 2020, the entire disclosure of which is incorporated herein by reference for all purposes. No new matter has been introduced.

TECHNICAL FIELD

The present disclosure relates to the field of refrigeration devices, and in particular, to a scroll compressor, a refrigeration device and a vehicle.

BACKGROUND

These statements herein merely provide background information related to the present disclosure and do not necessarily constitute the related art.

A scroll compressor is a positive displacement compressor with high efficiency, low noise and stable operation, and is widely used in an automotive air conditioning system as a third generation of an on-board compressor. Recently, with the development of new energy vehicles, requirements for noise, vibration and durability of an automotive air-conditioning scroll compressor are further increased. Here, during the use of the scroll compressor, a refrigeration oil needs to be supplied to lubricate a friction pair in the scroll compressor, so as to reduce a noise generated by the friction pair during its operation. In the related art, as shown in FIG. 1, an oil separation structure 100 is disposed in the scroll compressor to separate a mixed fluid of a refrigerant and an oil discharged from a compression chamber 30 of the scroll compressor, and a storage tank 12 is provided below the oil separation structure 100 to store the refrigeration oil separated by the oil separation structure 100. Meanwhile, a throttling oil return structure 40 is provided between the oil storage tank 12 and an oil return channel 20 of the scroll compressor, an oil return hole 121 is defined at a bottom of the oil storage tank 12 to be connected to the throttling oil return structure 40, so that the refrigeration oil in the oil storage tank 12 is finally returned to the oil return channel 20 of the scroll compressor through the throttling oil return structure 40, so as to lubricate each friction pair in the scroll compressor.

However, in the actual using process, since an oil discharging hole 1017 of the oil separation structure 100 is disposed to directly face towards the oil storage tank 12, a fluid discharged from the oil separation structure 100 may wash out the refrigeration oil in the oil storage tank 12, so that the refrigeration oil in the oil storage tank 12 will churn due to an impact, which causes a through hole of the oil storage tank 12 in communication with the throttling oil return structure 40 not to be completely immersed by the refrigeration oil. Thus, a refrigerant will leak directly from the throttling oil return structure 40 to a suction side of the scroll compressor, which in turn causes a decrease in a cooling capacity of the scroll compressor. In addition, when leaking through the throttling oil return structure 40, the refrigerant occupies a fluid delivery space of the throttling oil return structure 40, which results in a reduction in the refrigeration oil delivered to the oil return channel 20 through the throttling oil return structure 40. In addition, the churning of the refrigeration oil will also cause the refrigerant to be mixed and dissolved in the refrigeration oil again. Thus, a proportion of the refrigeration oil in the oil storage tank 12 will decrease, thereby further reducing the proportion of the refrigeration oil in a return oil, resulting in that the friction pair cannot be effectively lubricated, and the scroll compressor power consumption increases, thereby decreasing compression efficiency and occurring functional failures even in severe cases.

SUMMARY

Embodiments of the present disclosure provide a scroll compressor, a refrigeration device and a vehicle, which aim at solving at least the technical problem of insufficient lubrication of the friction pair of the scroll compressor in the related art, which achieves increased power consumption and reduced compression efficiency of the scroll compressor.

Embodiments of the present disclosure provide a scroll compressor, a refrigeration device and a vehicle, which aim at solving at least the technical problem of insufficient lubrication of the friction pair of the scroll compressor in the related art, which achieves increased power consumption and reduced compression efficiency of the scroll compressor.

In order to solve at least the above-mentioned technical problems, embodiments of the present disclosure provide a scroll compressor includes a housing. The housing has an oil separation structure, an oil storage tank, and an oil outlet channel that are provided therein. The oil outlet channel has an oil inlet and an oil outlet located above the oil inlet. The oil inlet is in communication with an oil discharging hole of the oil separation structure, and the oil outlet is in communication with the oil storage tank.

In some embodiments, the housing also has a refrigerant outlet defined thereon, and the oil storage tank has a vent hole defined on a wall thereof and in communication with the refrigerant outlet.

In some embodiments, the oil outlet channel has a flow area gradually increasing in a direction from the oil inlet to the oil outlet.

In some embodiments, the oil outlet channel is a curved channel having at least one curved section.

In some embodiments, the oil storage tank has a plurality of ribs provided on a wall thereof and arranged at intervals, and each of the plurality of ribs has one end facing towards a top of the oil storage tank and another end facing towards a bottom of the oil storage tank.

In some embodiments, the oil outlet is arranged away from the bottom of the oil storage tank.

In some embodiments, the oil outlet is arranged towards the bottom of the oil storage tank, and the oil storage tank has a buffer portion provided on a wall thereof and located below the oil outlet. A gap is defined between the buffer portion and the wall of the oil storage tank.

In some embodiments, the oil outlet channel is an oil outlet pipe. The oil outlet pipe includes an introduction section and a discharging section connected to the introduction section. A port of the introduction section facing away from the discharging section is formed as the oil inlet, and a port of the discharging section facing away from the introduction section is formed as the oil outlet.

In some embodiments, the scroll compressor also includes a stationary scroll disk, and a side wall of the stationary scroll disk facing towards the oil separation structure has a first communication slot and a second communication slot. The oil discharging hole is connected to the oil inlet by the first communication slot, and the vent hole is connected to the refrigerant outlet by the second communication slot.

In some embodiments, the scroll compressor also includes a seal attached to an end surface of the stationary scroll disk facing towards the oil separation structure. The end surface of the stationary scroll disk facing towards the oil separation structure has a recess defined thereon, and the recess has openings defined at two ends thereof and formed as the oil outlet and the oil inlet, respectively. The oil outlet channel is defined by the recess and the seal.

In some embodiments, the scroll compressor also includes a seal attached to an end surface of the stationary scroll disk facing towards the oil separation structure. An end surface of the stationary scroll disk facing away from the oil separation structure has a recess defined thereon, and the recess has openings defined at two ends thereof and formed as the oil outlet and the oil inlet, respectively. The oil outlet channel is defined by the recess and the end surface of the stationary scroll disk.

In some embodiments, the housing includes an oil separation shell having a connection surface. The connection surface matches with and is connected to an end surface of the stationary scroll disk facing towards the oil separation structure. The connection surface has a recess defined thereon, and the recess has openings defined at two ends thereof and formed as the oil outlet and the oil inlet, respectively. The end surface of the stationary scroll disk is attached to the connection surface. The oil outlet channel is defined by the end surface of the stationary scroll disk and the recess.

In some embodiments, the oil separation housing also has an accommodation groove provided therein and configured to accommodate the recess. The oil storage tank is defined by an inner wall surface of the accommodation groove and an outer wall surface the recess.

In some embodiments, the oil separation shell also has a connection channel defined therein, and the connection channel is configured to allow a precipitated refrigerant to flow therethrough. The connection channel has an inlet connected to the oil outlet, an outlet connected to the vent hole, and a wall connected to the wall of the oil storage tank.

In some embodiments, the wall of the connection channel has an oil blocking portion provided thereon, and a gap is formed between the oil blocking portion and an end surface of the oil outlet.

In some embodiments, the oil separation structure includes an oil separation chamber disposed in the oil separation shell, and the oil discharging hole and the refrigerant outlet are arranged on a wall of the oil separation chamber. The wall of the oil separation chamber also has an oil separation inlet defined thereon, and the stationary scroll disk has a mixed fluid outlet defined thereon and in communication with the mixed fluid outlet.

Another technical solution employed in embodiments of the present disclosure is a refrigeration device including the scroll compressor as described above.

Another technical solution employed in embodiments of the present disclosure is a vehicle including the refrigeration device as described above.

The above one or more technical solutions of the scroll compressor according to the embodiments of the present disclosure have at least one of the following technical effects. In the scroll compressor according to the embodiments of the present disclosure, by providing the oil outlet channel in the housing, communicating the oil inlet of the oil outlet channel with the oil discharging hole of the oil separation structure, and communicating the oil outlet of the oil outlet channel with the oil storage tank, the refrigeration oil discharged from the oil separation structure can first enter the oil outlet channel through the oil inlet, and then flow into the oil storage tank through the oil outlet of the oil outlet channel. Since the oil outlet of the oil outlet channel is arranged above the oil inlet, the refrigeration oil entering the oil outlet channel flows against the direction of gravity and then is discharged through the oil outlet. In this way, the outflow pressure and outflow velocity of the refrigeration oil can be effectively reduced. Thus the flow rate and the pressure of the refrigeration oil discharged from the outlet are reduced, and the impact of the refrigeration oil on the refrigeration oil in the oil storage tank is reduced when the refrigeration oil is discharged, so that the refrigeration oil in the oil storage tank can be maintained stable, and the refrigeration oil in the oil storage tank does not churn due to the inflow of the refrigeration oil. Therefore, the effective oil storage volume and oil storage capacity of the oil storage tank can be increased. Meanwhile, the refrigeration oil in the oil storage tank remains stable, and it is also possible to ensure that the oil return hole is always submerged by the refrigeration oil, thereby preventing the refrigerant from leaking into the oil return channel through the oil return hole. Thus, it is possible to ensure that the scroll compressor has sufficient oil return, and a friction pair of the scroll compressor can be effectively lubricated, thereby improving the compression efficiency of the scroll compressor.

In the refrigeration device according to the embodiments of the present disclosure, by using the scroll compressor as described above, since the oil outlet channel is disposed in the housing of the scroll compressor and the oil outlet channel can guide the refrigeration oil to flow against the direction of gravity, the outflow velocity and the outflow pressure can be reduced when the refrigeration oil is discharged into the oil storage tank, thereby reducing the impact on the refrigeration oil in the oil storage tank when the refrigeration oil is discharged, and ensuring that the refrigeration oil in the oil storage tank remains stable. Thus, the effective oil storage volume of the oil storage tank can be increased, and the oil return hole of the oil storage tank is always submerged by the refrigeration oil, which preventing the refrigerant from leaking directly into the oil return channel of the scroll compressor through the oil return hole. Therefore, the scroll compressor has sufficient oil return and improved compression efficiency, thereby optimizing the refrigeration capacity of the refrigeration device.

In the vehicle according to the embodiments of the present disclosure, by using the refrigeration device as described above, during the refrigeration of the vehicle, since the refrigeration capacity and refrigeration efficiency of the refrigeration device can always be maintained at a higher level, the cooling time inside the vehicle can be effectively shortened. Thus, the cooling speed of the vehicle is boosted, thereby improving vehicle use experience.

BRIEF DESCRIPTION OF DRAWINGS

In order to illustrate the technical solutions in the embodiments of the present disclosure more clearly, the following briefly introduces the accompanying drawings that are used in the description of the embodiments or exemplary technologies. Obviously, the drawings in the following description are only some embodiments of the present disclosure.

For those of ordinary skill in the art, other drawings may also be obtained according to these drawings without any inventive step.

Figure 1:
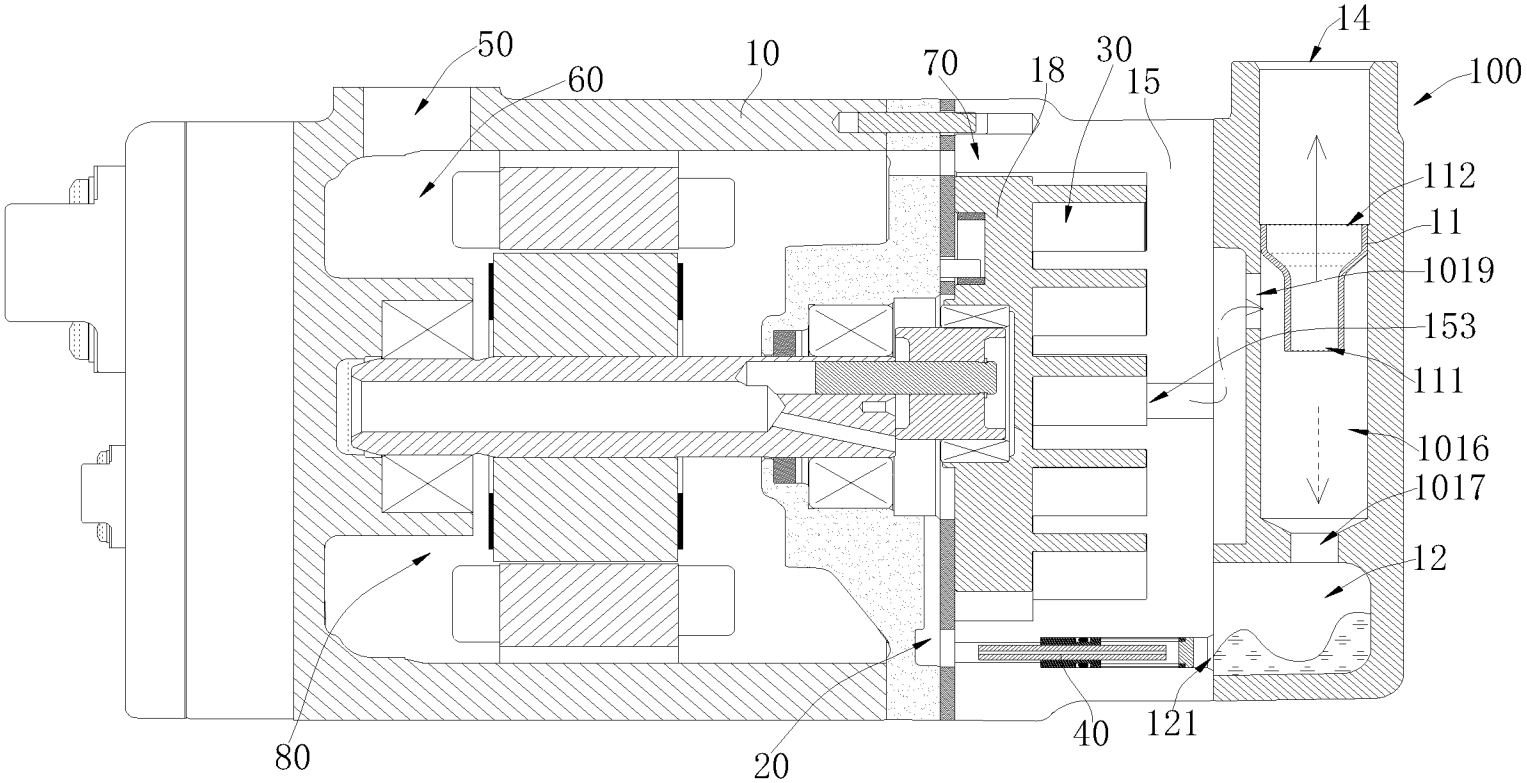
FIG. 1 is a sectional view of a scroll compressor in the related art.

The reference numerals shown in the figures are described as follows:

10—housing; 100—oil separation structure; 101—oil separation shell; 1011—connection surface; 1012—accommodation groove; 1013—connection channel; 1014—oil blocking portion; 1015—oil blocking surface; 1016—oil separation chamber; 1017—oil discharging hole; 1018—rectification chamber; 1019—oil separation inlet; 1020—mixed fluid inlet; 1021—streamlined wall surface; 11—oil separation tube; 111—intake end; 112—outtake end; 12—oil storage tank; 121—oil return hole; 122—vent hole; 123—rib; 13—oil outlet channel; 131—oil inlet; 132—oil outlet; 133—introduction section; 134—discharging section; 14—refrigerant outlet; 15—stationary scroll disk; 151—first communication slot; 152—second communication slot; 153—mixed fluid outlet; 16—seal; 161—avoidance position; 17—groove; 18—orbiting scroll disk; 20—oil return channel; 30—compression chamber; 40—throttling oil return structure; 50—suction port; 60—suction chamber; 70—compression mechanism; 80—driving mechanism.

DESCRIPTION OF EMBODIMENTS

In order to make the technical problems to be solved, technical solutions and beneficial effects in the present disclosure clearer, the present disclosure will be described in further detail below with reference to the accompanying drawings including FIGS. 1 to 10 and the embodiments. It should be understood that the exemplary embodiments described herein are only used to explain the present disclosure, rather than limiting the present disclosure.

It should be noted that, in the description of this application, when an element is referred to as being "fixed on" or "disposed on" another element, it may be directly or indirectly on another element. When an element is referred to as being "connected to" another element, it may be directly or indirectly connected to another element.

It should to be understood that the orientation or positional relationship by terms "length", "width", "upper", "lower", "front", "rear", "left", "right", "vertical", "horizontal", "top", "bottom", "inside", "outside", etc. is based on the orientation or positional relationship shown in the accompanying drawings, which only for the convenience of describing the present disclosure and simplifying the description, rather than indicating or implying a device or an element must have a particular orientation, be constructed and operate in a particular orientation, therefore it should not be construed as a limitation on the present disclosure.

In addition, the terms "first" and "second" are only used for descriptive purposes, and should not be construed as indicating or implying relative importance or implying the number of indicated technical features. Thus, a feature defined as "first" or "second" may expressly or implicitly include one or more of that features. In the description of the present disclosure, "a plurality of" means two or more, unless otherwise expressly and In some embodiments defined.

Reference in this specification to "one embodiment," "some embodiments," or "an embodiment" means that a particular feature, structure, or characteristic described in connection with the embodiment is included in one or more embodiments of the disclosure. Thus, appearances of the phrases "in one embodiment," "in some embodiments," "in other embodiments," "in other embodiments," etc. throughout the specification are not necessarily all refer to the same embodiment, but mean "one or more but not all embodiments", unless otherwise In some embodiments emphasized. Furthermore, the particular features, structures or characteristics may be combined in any suitable manner in one or more embodiments.

In order to illustrate the technical solutions described in the present disclosure, a detailed description is given below with reference to the specific drawings and embodiments.

Figure 2:
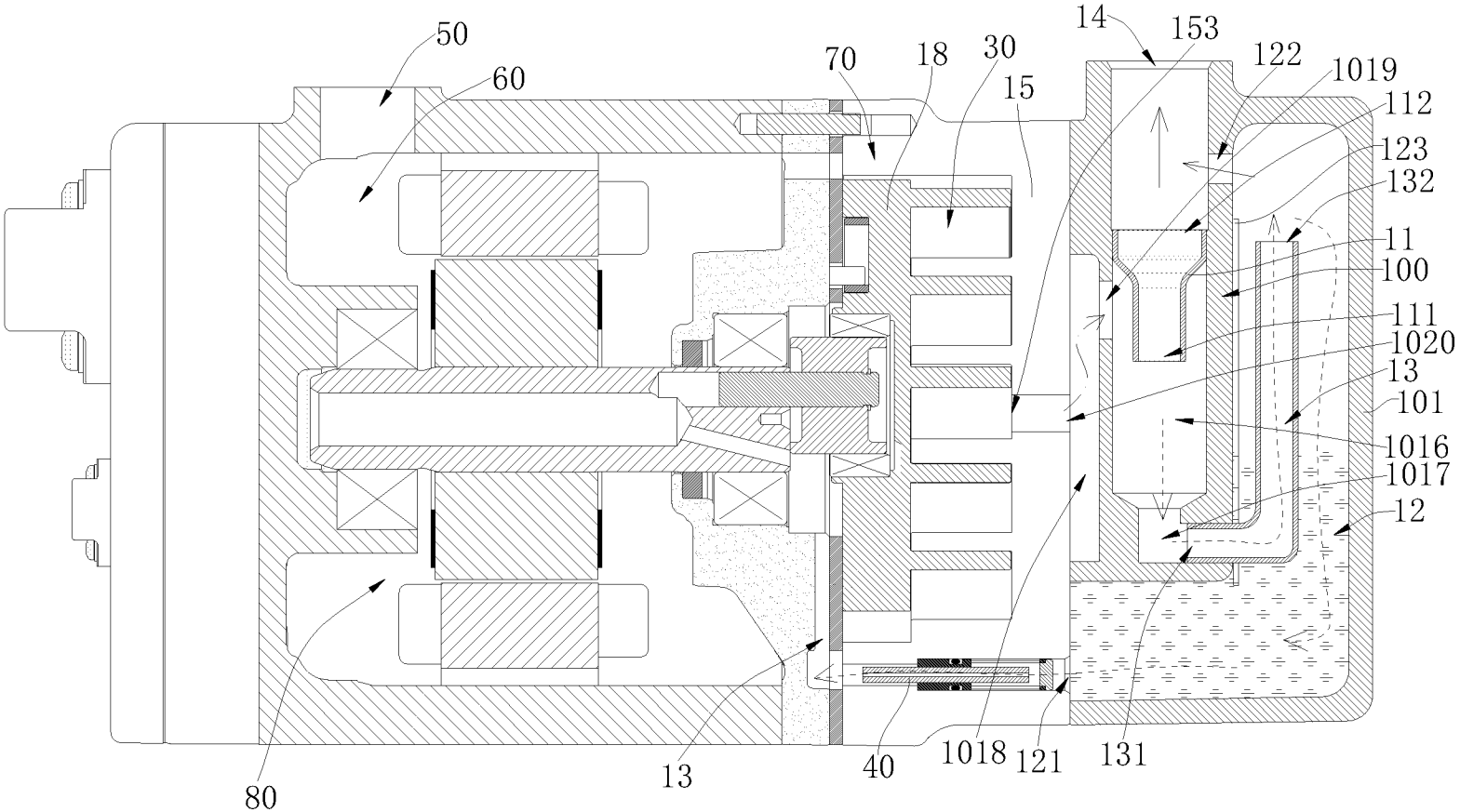
FIG. 2 is a sectional view of a scroll compressor according to an embodiment of the present disclosure.

As shown in FIGS. 2 to 7, an embodiment of the present disclosure provides a scroll compressor. As shown in FIG. 2, the scroll compressor may include, but is not limited to, a housing 10, a suction port 50, a compression mechanism 70, a driving mechanism 80, and a refrigerant outlet 14 and the like.

Here, the compression mechanism 70 may include, but is not limited to, an orbiting scroll disk 18, a stationary scroll disk 15, and an anti-rotation structure. The stationary scroll disk 15 may include an end plate and a stationary scroll, and the orbiting scroll disk 18 may include an end plate and an orbiting scroll. The stationary scroll and the orbiting scroll are engaged with each other, thereby defining a compression chamber 30 of the scroll compressor (i.e., a working chamber of the scroll compressor) between the stationary scroll and the orbiting scroll. The anti-rotation device is used to limit a rotation of the orbiting scroll disk 18 and to allow the orbiting scroll disk 18 to perform a rotational and translational motion relative to the stationary scroll disk 15. The driving mechanism 80 may include, but is not limited to, a crankshaft and a motor composed of a stator and a rotor. The crankshaft may rotate integrally with the rotor, and an eccentric pin suitable for driving the orbiting scroll disk 18 may be provided at an upper end of the crankshaft. The rotor is capable of driving the orbiting scroll disk 18 to rotate by the eccentric pin. The suction port 50 is defined on the housing 10 and is in communication with a refrigerant supply port of an external working circuit (such as an outlet of a system evaporator, etc.). The housing 10 further has a suction chamber 60 defined therein, and the suction chamber 60 communicates the suction port 50 with the compression chamber 30, and a low-pressure refrigerant (a working fluid) from the external working circuit of the housing 10 (such as the system evaporator, etc.) is sucked through the suction port 50, and enters a compression mechanism 70 through the suction chamber 60 for compression. The housing 10 has an oil separation structure 100 and an oil storage tank 12 provided therein. A mixed fluid of a refrigerant and a refrigeration oil discharged from the compression chamber 30 is output to the oil separation structure 100 for an oil and gas separation. A refrigerant outlet 14 is defined on the housing 10. A high-pressure refrigerant separated by the oil separation structure 100 is discharged to the external working circuit of the scroll compressor (such as, an inlet of the system evaporator, etc.) through the refrigerant outlet 14. The refrigeration oil separated by the oil separation structure 100 is discharged from an oil discharging hole 1017, and flows and is stored in the oil storage tank 12. An oil storage region is formed in the oil storage tank 12. Here, the oil storage region refers to an region where the refrigeration oil is stored in the oil storage tank 12 when the scroll compressor of this embodiment is used. A wall of the oil storage tank 12 has an oil return hole 121 for discharging the refrigeration oil. The oil return hole 121 is located in an oil outlet region. In some embodiments, the oil return hole 121 may be, but is not limited to, disposed at the bottom of the oil storage tank 12. The housing 10 also has an oil return channel 20 in communication with the oil return hole 121. A throttling oil return structure 40 is provided between the oil return channel 20 and the oil storage tank 12, and the refrigeration oil in the oil storage tank 12 is delivered into the oil return channel 20 through the throttling oil return structure 40 to lubricate each of friction pairs of the scroll compressor.

When the scroll compressor is operated and the motor is energized, the rotor rotates to drive the crankshaft to rotate synchronously. The crankshaft is capable of driving the orbiting scroll disk 18 to perform the rotational and translational motion by the eccentric pin. Meanwhile, the refrigerant, that is, the working fluid, enters the suction chamber 60 of the compression mechanism 70 through the suction port 50, and is further sucked into the compression chamber 30 from the suction chamber 60 as the orbiting scroll disk 18 continues to perform the rotational and translational motion. At this time, the refrigerant in the compression chamber 30 is compressed to increase the pressure. When the refrigerant is compressed to a predetermined compression ratio, the refrigerant is discharged from the compression chamber 30. For example, a mixed fluid outlet 153 is defined on the stationary scroll disk 15, and the refrigerant is discharged through the mixed fluid outlet 153. During compressing the refrigerant, the refrigeration oil for lubricating the friction pair will be carried by the refrigerant and enter the compression chamber 30. Therefore, the fluid discharged from the mixed fluid outlet 153 of the stationary scroll disk 15 is a mixed fluid of the refrigerant and refrigeration oil, and the discharged mixed fluid needs to be treated to be separated into the refrigerant and the refrigeration oil. In this way, the mixed fluid of the refrigerant and the refrigeration oil will be delivered to the oil separation structure 100 to be separated into the refrigerant and the refrigeration oil. The resulted refrigerant is discharged from the refrigerant outlet 14 to the scroll compressor, and the resulted refrigeration oil enters the oil storage tank 12, and then flows into the throttling oil return structure 40 through the oil return hole 121, and enters into the oil return channel 20 to lubricate the friction pair, thereby realizing a recycling of the refrigeration oil.

Figure 3:
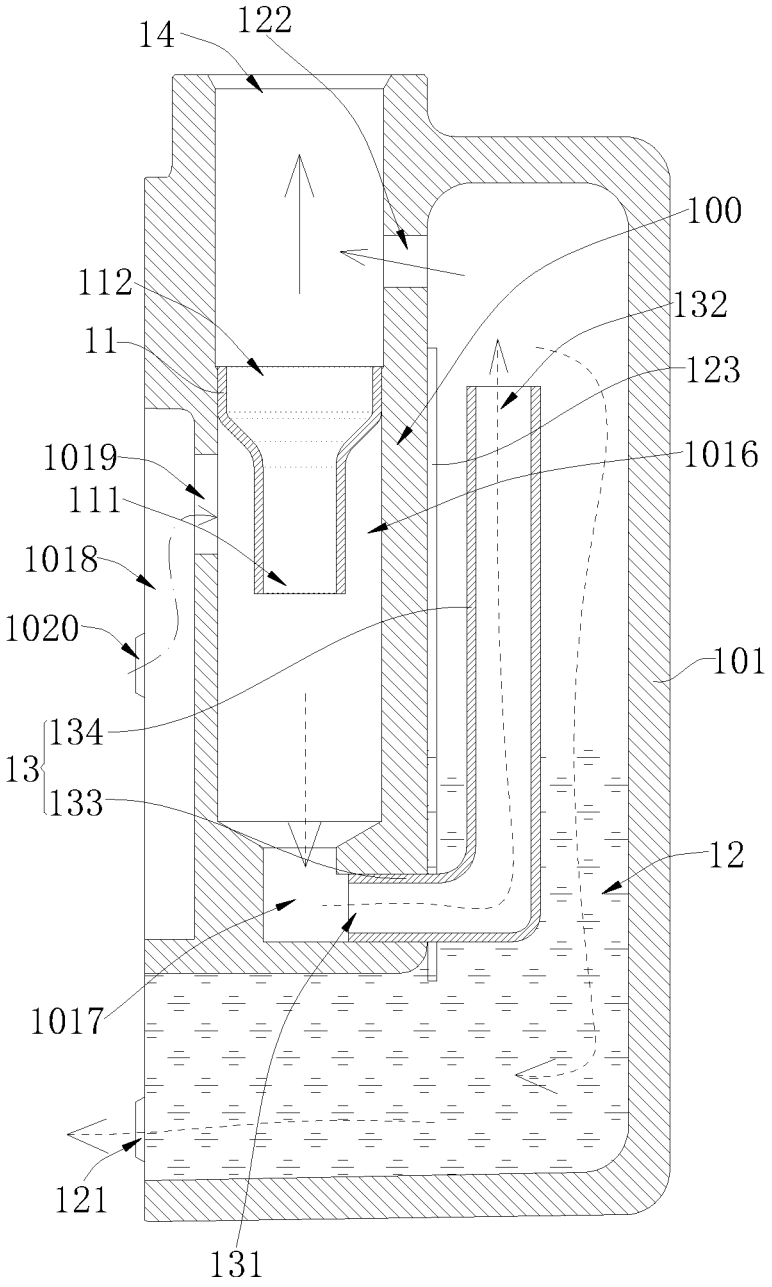
FIG. 3 is a partial sectional view of the scroll compressor shown in FIG. 2.
Figure 4:
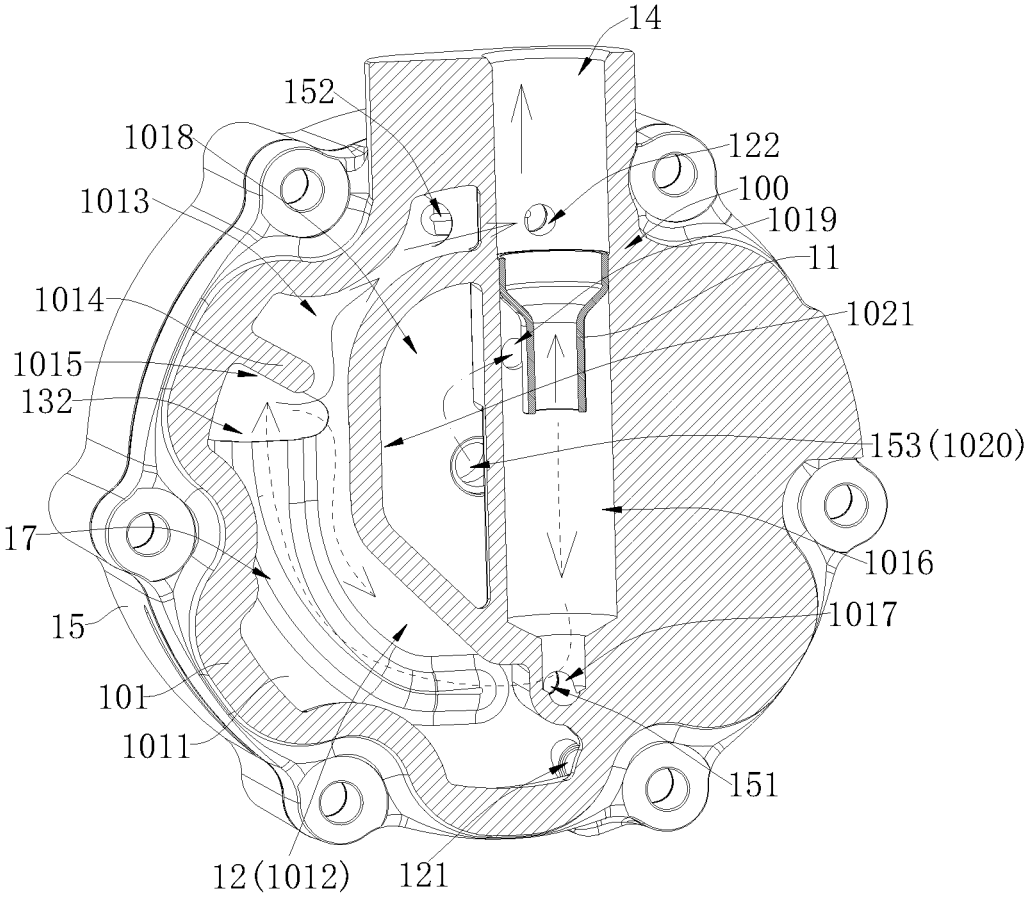
FIG. 4 is a partial sectional view of a scroll compressor according to another embodiment of the present disclosure.

In an embodiment of the present disclosure, as shown in FIG. 2, FIG. 3 and FIG. 4, the housing 10 of the scroll compressor as described also has an oil outlet channel 13 defined therein. The oil outlet channel 13 is configured to guide the refrigeration oil discharged from the oil discharging hole 1017 of the oil separation structure 100 to the oil storage tankl2. In some embodiments, the oil outlet channel 13 has an oil inlet 131 and an oil outlet 132 that are arranged opposite to each other. The oil outlet 132 is located above the oil inlet 131. In some embodiments, the oil outlet 132 being located above the oil inlet 131 means that, in a direction of gravity, the oil outlet 132 is located directly above or obliquely above the oil inlet 131. After the refrigeration oil flows into the oil outlet channel 13 from the oil inlet 131, the refrigeration oil needs to flow against the direction of gravity before it can flow to be discharged from the oil outlet 132. Here, the oil inlet 131 is in communication with the oil discharging hole 1017 of the oil separation structure 100, and is configured for an inflow of the refrigeration oil discharged from the oil discharging hole 1017 of the oil separation structure 100. The oil outlet 132 is in communication with the oil storage tank 12 to introduce the refrigeration oil into the oil storage tank 12.

Further, in this embodiment, the oil outlet 132 is located above the oil storage region of the oil storage tank 12. In this way, by arranging the oil outlet 132 above the oil storage region, it is possible to ensure that the oil outlet 132 is always located above a level of the refrigeration oil in the oil storage tank 12. Thus, as a storage capacity of the refrigeration oil in the oil storage tank 12 increases, the refrigeration oil will never submerge the oil outlet 132, so as to prevent the oil outlet 132 from being positioned in the refrigeration oil to discharge the refrigeration oil, thereby avoiding air bubbles from being generated to result in a churning of the refrigeration oil when the refrigeration oil is discharged, or avoiding the air bubbles from entering the throttling oil return structure 40 through the oil return hole 121 to occupy an interior space of the throttling oil return structure 40.

In the scroll compressor according to the embodiments of the present disclosure, by forming the oil outlet channel 13 inside the housing 10 and communicating the oil inlet 131 of the oil outlet channel 13 with the oil discharging hole 1017 of the oil separation structure 100 of the scroll compressor, and communicating the oil outlet 132 of the oil outlet channel 13 with the oil storage tank 12 of the scroll compressor, the refrigeration oil discharged from the oil discharging hole 1017 of the oil separation structure 100 first enters the oil outlet channel 13 through the oil inlet 131, and then flows into the oil storage tank 12 through the oil outlet 132 of the oil outlet channel 13. In this embodiment, an oil flow path is shown by the dashed arrows in FIGS. 2, 3 and 4. Since the oil outlet 132 of the oil outlet channel 13 is positioned above the oil inlet 131 in the direction of gravity, the refrigeration oil entering the oil outlet channel 13 flowing against the direction of gravity. In this way, a pressure and a flow rate of the refrigeration oil can be effectively reduced. Thus, the flow rate and the pressure of the refrigeration oil discharged from the oil outlet 132 are reduced, and an impact on the remaining refrigeration oil in the oil storage tank 12 is reduced when the refrigeration oil is discharged, so that the refrigeration oil in the oil storage tank 12 can be maintained stable, and the refrigeration oil in the oil storage tank 12 would not be churned due to the oil flowing. Thus, an effective oil storage volume and oil storage capacity of the oil storage tank 12 can also be increased. Meanwhile, the refrigeration oil in the oil storage tank 12 can be maintained stable, and it is also possible to ensure that the oil return hole 121 is always submerged by the refrigeration oil, so as to prevent the refrigerant from directly leaking into the oil return channel 20 through the oil return hole 121, thereby ensuring that the scroll compressor has sufficient oil return, and the friction pair of the scroll compressor is effectively lubricated, thereby improving the compression efficiency of the scroll compressor.

In another embodiment of the present disclosure, as shown in FIG. 2, FIG. 3 and FIG. 4, the housing 10 has the refrigerant outlet 14 defined thereon, and the refrigerant separated by the oil separation structure 100 is discharged through the refrigerant outlet 14. Further, since the flow rate and the pressure of the refrigeration oil are reduced after flowing through the oil outlet channel 13, the refrigerant partially dissolved in the refrigeration oil will precipitate. Thus, the oil storage tank 12 has a vent hole 122 defined on the wall thereof, and the precipitated refrigerant is discharged through the vent hole 122. Further, the vent hole 122 is in communication with the refrigerant outlet 14 on the housing 10, and the refrigerant precipitated from the refrigeration oil and entering the oil storage tank 12 is merged into the refrigerant outlet 14 through the vent hole 122 and discharged from the refrigerant outlet 14. In this embodiment, a flow path of the refrigerant are shown by solid arrows in FIGS. 2, 3 and 4. In this embodiment, when the refrigeration oil flows out of the oil outlet channel 13, the pressure of the refrigeration oil is reduced, so that the refrigerant dissolved in the refrigeration oil is precipitated, and the precipitated refrigerant is discharged through the vent hole 122 to prevent the refrigerant from retaining in the oil storage tank 12, which achieves an increased internal pressure of the oil storage tank 12, so that the precipitated refrigerant is dissolved in the refrigeration oil again. In some embodiments, the vent hole 122 is provided to discharge the refrigerant to ensure that a pressure Pk at the oil inlet 131 of the oil outlet channel 13 is always greater than a pressure Pd' at the oil outlet 132. That is, a pressure difference (Pk−Pd'>0) is formed between the oil outlet 132 and the oil inlet 131 of the oil outlet channel 13, so as to ensure that the refrigeration oil can be discharged from the oil outlet 132 of the oil outlet channel 13 with the pressure difference. In this case, even the refrigeration oil flows against the direction of gravity, it can still flow out of the oil outlet 132 smoothly to avoid interruption or backflow.

In another embodiment of the present disclosure, as shown in FIG. 2, FIG. 3 and FIG. 4, the vent hole 122 and the oil return hole 121 are spaced apart from each other in the direction of gravity. The oil outlet channel 13 is arranged between the vent hole 122 and the oil return hole 121, and the oil inlet 131 is arranged close to the oil return hole 121. Further, the oil outlet 132 is also arranged close to the vent hole 122. That is, the oil inlet 131 is located above the oil return hole 121, and the vent hole 122 is located above the oil outlet 132. In this way, by arranging the vent hole 122 above the oil outlet 132, it is possible to prevent the refrigeration oil sprayed from the oil outlet 132 from entering the vent hole 122 when flowing along the wall of the oil storage tank 12 and being discharged through the vent hole 122 along with the refrigerant.

In another embodiment of the present disclosure, as shown in FIG. 2, FIG. 3 and FIG. 4, in a direction from the oil inlet 131 to the oil outlet 132 of the oil outlet channel 13, a flow area of the oil outlet channel 13 gradually increases. That is, in a flow direction of the refrigeration oil, the flow area of the oil outlet channel 13 gradually increases. In this way, during the flow of the refrigeration oil along the oil outlet channel 13, as the flow area gradually increase, the flow rate of the refrigeration oil gradually decreases, and a speed of the refrigeration oil when discharged from the oil outlet 132 decreases, thereby further reducing the impact on the level when the refrigeration oil is discharged from the oil outlet 132. In addition, the flow rate of the refrigeration oil is slowed down, which can further increase a precipitation amount of the refrigerant during the flowing, thereby further reducing an amount of refrigerant dissolved in the refrigeration oil entering the oil storage tank 12 and increasing the proportion of the refrigeration oil entering the oil return channel 20 of the scroll compressor.

In some other embodiments, in the direction from the oil inlet 131 to the oil outlet 132, the flow area of the oil outlet channel 13 can also be constant. That is, in the flow direction of the refrigeration oil, the flow area of the oil outlet channel 13 is constant. In this case, since the oil outlet channel 13 has a frictional resistance, the flow rate can also be gradually slowed down when the refrigeration oil flows through the oil outlet channel 13.

In another embodiment of the present disclosure, as shown in FIG. 2, FIG. 3 and FIG. 4, the above oil outlet channel 13 is a curved channel with at least one curved section. By forming the oil outlet channel 13 into the curved channel with the curved section, the refrigeration oil can flow into the oil outlet channel 13 at a high velocity, and hit a channel wall when turning in the curved section. Thus, a local resistance of the refrigeration oil increases during the flowing, which can further reduce the flow rate and the pressure of the refrigeration oil. In this way, forming the oil outlet channel 13 with the curved section can reasonably utilize the area of the curved section to prolong a residence time of the refrigeration oil in the oil outlet channel 13, such that more refrigerant dissolved in the refrigeration oil is precipitated. Meanwhile, the local resistance of oil outlet channel 13 can be increased, thereby effectively reducing the flow rate and the pressure of refrigeration oil.

Further, in this embodiment, the oil outlet channel 13 is formed into an L-shaped channel with one curved section, and the curved section of the L-shaped channel is rounded to avoid excessive impact of the refrigeration oil on the channel wall and wear of the channel. In other embodiments, the above oil outlet channel 13 may also be an S-shaped channel with several curved sections, etc., or other channels with one or more curved sections. Here, the specific form of the oil outlet channel 13 is not uniquely limited.

In another embodiment of the present disclosure, as shown in FIG. 2 and FIG. 3, the oil storage tank 12 has a plurality of ribs 123 provided on the wall thereof, and the plurality of ribs 123 is arranged at intervals. Further, one end of each of the plurality of ribs 123 is arranged to face towards the top of the oil storage tank 12, and the other opposite end of each of the plurality of ribs 123 is arranged to face towards the bottom of the oil storage tank 1. That is, the plurality of ribs 123 extend from one end of the oil storage tank 12 to the other opposite end in the direction of gravity. By arranging the plurality of ribs 123 on the wall of the oil storage tank 12, on one hand, these ribs 123 can guide the refrigeration oil discharged from the oil outlet 132 to the oil storage tank 12, thereby further reducing scouring of the oil output from the oil outlet 132 to the refrigeration oil in the oil storage tank 12, and on the other hand, these ribs 123 can also further absorb heat of the refrigeration oil to further reduce a temperature of the refrigeration oil entering the oil storage tank 12, thereby increasing a precipitation amount of the refrigerant.

Further, in this embodiment, as shown in FIGS. 2 and 3, one end of each rib 123 facing away from the oil outlet 132 extends to the bottom of the oil storage tank 12. That is, when the refrigeration oil is stored in the oil storage tank 12, one end of the rib 123 facing away from the oil outlet 132 extends below a level of the refrigeration oil, so that the refrigeration oil ejected from the oil outlet 132 can be directly guided to be mixed with the refrigeration oil in the oil storage tank 12, thereby minimizing the scouring of the incoming refrigeration oil to the level of the refrigeration oil in the oil storage tank 12.

Further, in this embodiment, the plurality of ribs 123 can be, but not limited to, integrally formed on the wall of the oil storage tank 12. Thus, the processing is simple, and the forming and manufacturing are convenient.

In another embodiment of the present disclosure, as shown in FIGS. 2 and 3, the oil outlet 132 is arranged away from the bottom of the oil storage tank 12. That is, when the oil storage tank 12 stores the refrigeration oil, the oil outlet 132 is arranged away from the level of the refrigeration oil. In this way, the arrangement of the oil outlet channel 13 can change an outflow direction of the refrigeration oil, and the refrigeration oil discharged from the oil outlet 132 does not directly face towards the level of the refrigeration oil, so that the refrigeration oil will not directly scour the level of the refrigeration oil, thereby further reducing the impact of the refrigeration oil discharged from the oil outlet 132 on the refrigeration oil in the oil storage tank 12, which can provide a good guarantee for maintaining the stability of the refrigeration oil in the oil storage tank 12.

Further, in this embodiment, the oil outlet 132 is located below the vent hole 122 in the direction of gravity to prevent the refrigeration oil discharged from the oil outlet 132 from entering the vent hole 122 and being discharged through the vent hole 122 together with the refrigerant when flowing along the wall of the oil storage tank 12. In this embodiment, a valve structure for blocking the outflow of the refrigeration oil may also be disposed in the vent hole 122 to prevent the refrigeration oil of too high outflow velocity from being discharged through the vent hole 122.

In some other embodiments, the vent hole 122 may also be arranged below the oil outlet 132. In this case, a valve for blocking the outflow of the refrigeration oil needs to be disposed in the vent hole 122 to prevent the refrigeration oil from be discharged through the vent hole 122.

In another embodiment of the present disclosure, the oil outlet 132 may also not be arranged away from the bottom of the oil storage tank 12. That is, the oil outlet 132 may be arranged towards the bottom of the oil storage tank 12. In this case, a buffer portion (not shown) may be provided between the oil storage region of the oil storage tank 12 and the oil outlet 132, i.e., between the level of the refrigeration oil and the oil outlet 132, and it is ensured that a gap is formed between the buffer portion and the wall of the oil storage tank 12 for the refrigeration oil to flow therethrough. In this way, the refrigeration oil discharged from the oil outlet 132 falls into the oil storage tank 12 after hitting the buffer portion. Thus, with the arrangement of the buffer portion, it is possible to further buffer the impact of the refrigeration oil. Even if the oil outlet 132 is arranged towards the level of the refrigeration oil, the impact of the refrigeration oil discharged from the oil outlet 132 on the refrigeration oil in the oil storage tank 12 is relatively less.

Further, in this embodiment, the buffering portion is a buffering baffle protruding from the wall of the oil storage tank 12. A side wall of the buffer baffle and a side wall of the oil storage tank 12 are spaced apart from each other to form a gap therebetween for the flowing of the refrigeration oil therethrough. In some embodiments, the buffer portion is an orifice plate protruding from the wall of the oil storage tank 12, and the orifice plate has a plurality of through holes defined thereon. The refrigeration oil flows out through the through holes on the orifice plate.

In another embodiment of the present disclosure, as shown in FIG. 2, the above-mentioned oil outlet channel 13 may be an oil outlet pipe including an introduction section 133 and a discharging section 134 connected to the introduction section 133. The oil inlet 131 is formed by a port of the introduction section 133 facing away from the discharging section 134, and the oil outlet 132 is formed by a port of the discharging section 134 facing away from the introduction section 133. In this way, the oil outlet channel 13 can employ a pipeline-type channel, and a suitable pipeline is selected to be disposed in the housing 10 of the scroll compressor to form the above-mentioned oil outlet channel 13. The oil outlet channel 13 thus has a relatively simple structure and can be readily manufactured and formed.

Further, in this embodiment, the discharging section 134 is connected to the introduction section 133 at an angle, and the curved section of the oil outlet channel 13 is formed at a position of the connection angle. In this embodiment, the connection angle between the introduction section 133 and the discharging section 134 may be an acute angle, a right angle or an obtuse angle.

Further, in this embodiment, the discharging section 134 penetrates the wall of the oil storage tank 12, so that the oil outlet 132 extends into the oil storage tank 12. That is, the discharging section 134 is inserted into the wall of the oil storage tank 12 to ensure that the oil outlet 132 extends into the oil storage tank 12. In some embodiments, the introduction section 133 penetrates the wall of the oil storage tank 12. That is, the introduction section 133 is inserted into the wall of the oil storage tank 12, and a part of the introduction section 133 connected to the discharging section 134 extends into the oil storage tank 12. The discharging section 134 is entirely located in the oil storage tank 12. In this way, a non-oil storage space of the oil storage tank 12 located at an upper part thereof can be reasonably utilized, and an arrangement space of the oil outlet channel 13 can be reduced as much as possible.

Figure 5:
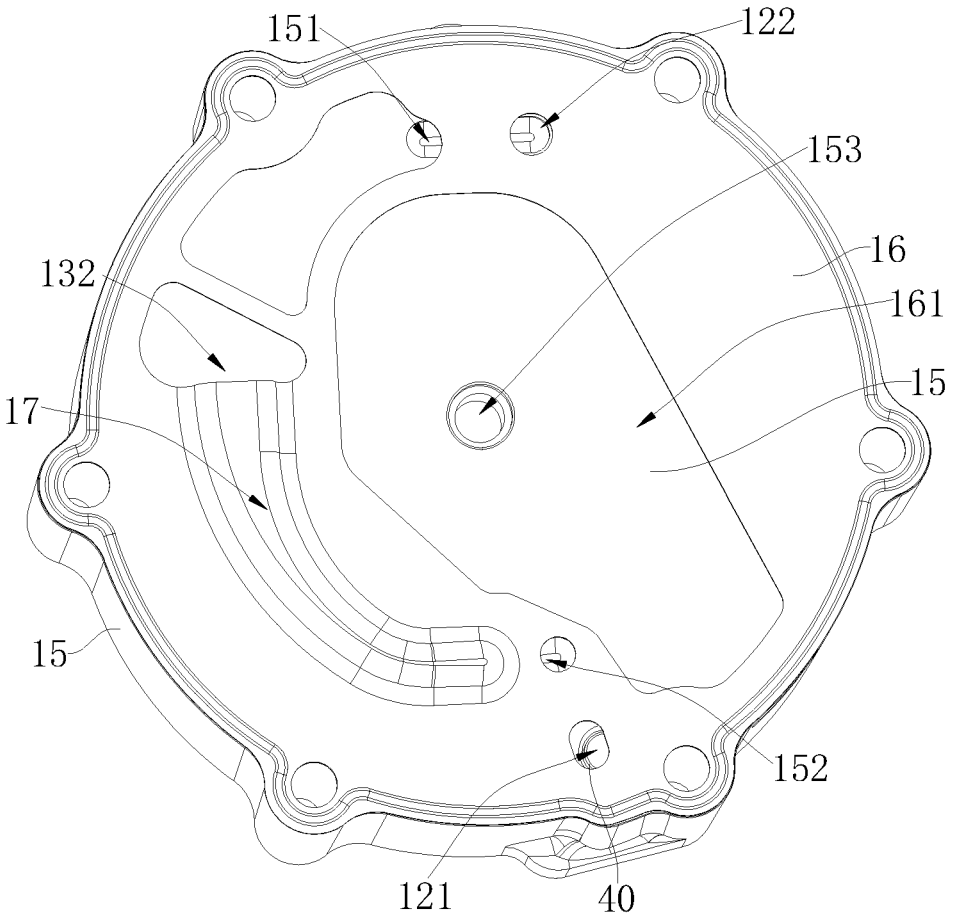
FIG. 5 is a schematic structural view of a seal of the scroll compressor and a stationary scroll disk of the scroll compressor shown in FIG. 4 when assembled.
Figure 6:
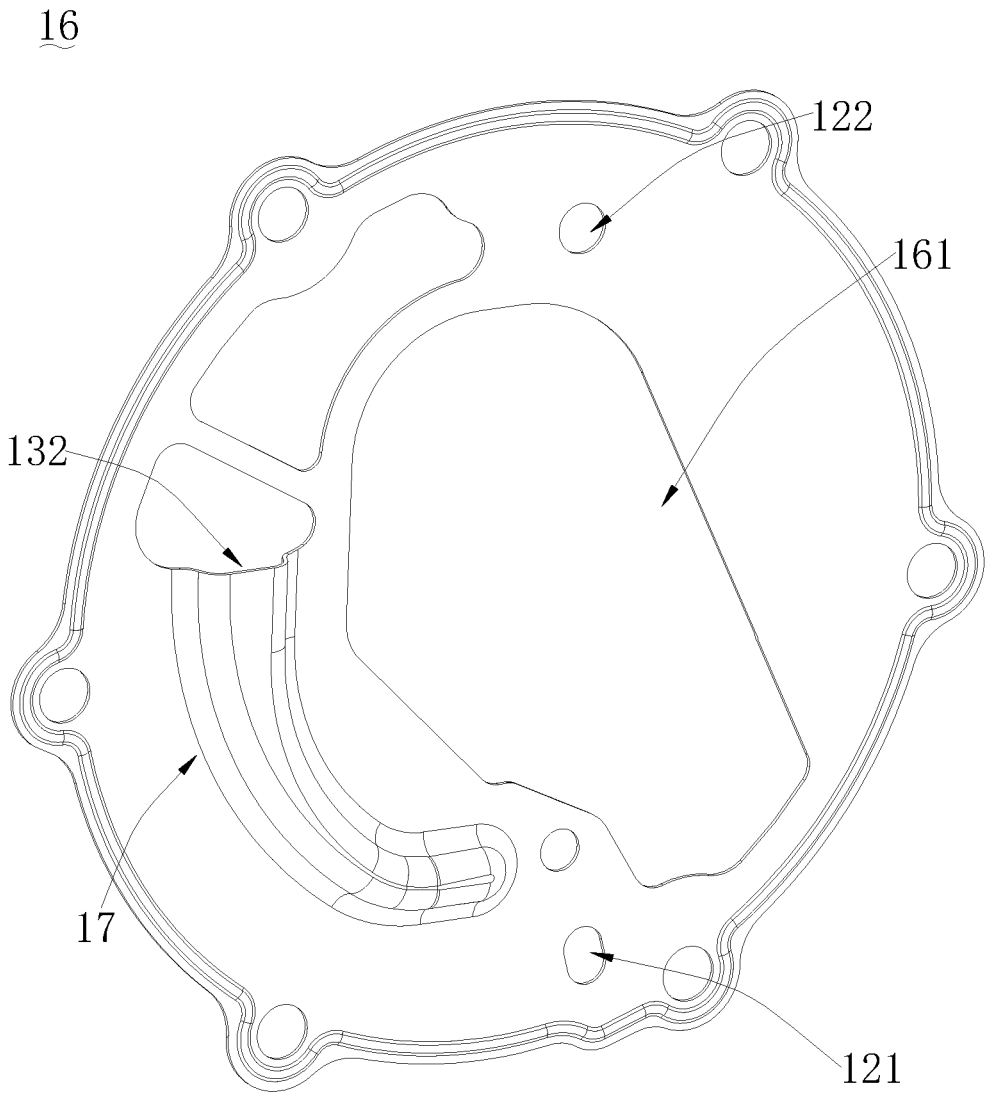
FIG. 6 is a schematic structural view of a seal shown in FIG. 4.
Figure 7:
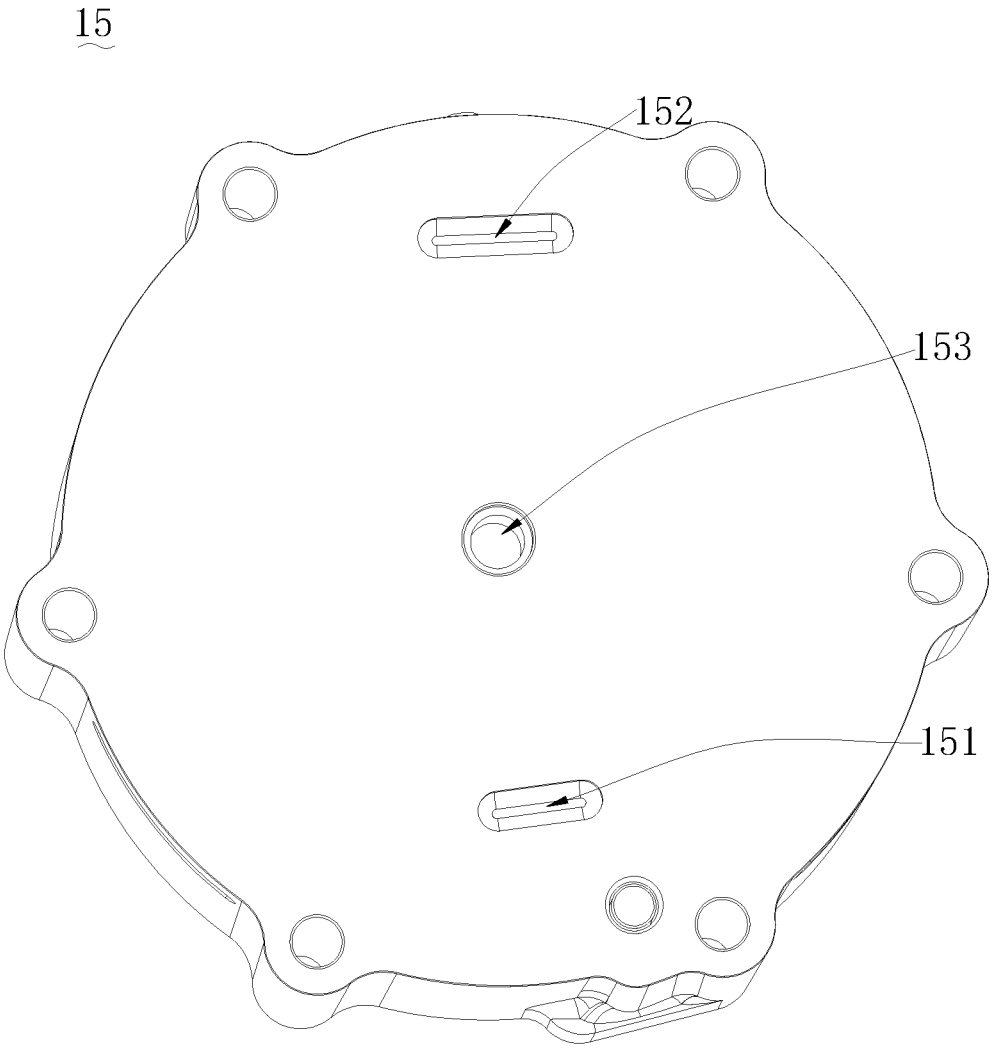
FIG. 7 is a schematic structural view of a stationary scroll disk shown in FIG. 4.

As shown in FIGS. 4 to 7, in another embodiment of the present disclosure, as an alternative to the above-mentioned embodiment, a side wall, facing towards the oil separation structure 100, of the stationary scroll disk 15 of the scroll compressor in this embodiment has a first communication slot 151 and a second communication slot 152 that are defined thereon. As shown in FIG. 7, the first communication slot 151 is arranged close to the oil inlet 131, and the second communication slot 152 is arranged close to the refrigerant outlet 14. The oil discharging hole 1017 is connected to the oil inlet 131 through the first communication slot 151, and the vent hole 122 is connected to the refrigerant outlet 14 through the second communication slot 152. By forming the first communication slot 151 and the second communication slot 152 on the stationary scroll disk 15, the refrigeration oil discharged from the oil discharging hole 1017 flows into the oil inlet 131 of the oil outlet channel 13 through the first communication slot 151, and the refrigerant discharged from the vent hole 122 of the oil storage tank 12 is discharged through the second communication slot 152. In this way, there is no need to provide additional pipelines or pipes in the housing 10 of the scroll compressor to guide the flow of the refrigeration oil or the refrigerant. Thus, the existing structure of the scroll compressor can be reasonably utilized to simplify the overall structure of the scroll compressor of the present embodiment.

In this embodiment, as shown in FIG. 5 and FIG. 6, the scroll compressor also includes a seal 16 attached to an end surface (that is, a side wall of the stationary scroll disk 15 facing away from the orbiting scroll disk 18) of the stationary scroll disk 15 facing towards the oil separation structure 100. Further, the seal 16 is substantially the same as the end surface of the stationary scroll disk 15 in shape and as the side wall of the stationary scroll disk 15 in size, which ensures that an overall appearance of the scroll compressor is more beautiful. Further, the end surface of the stationary scroll disk 15 facing towards the oil separation structure 100 has a recess 17 defined thereon, and the recess 17 has openings defined at two ends thereof. The oil outlet channel 13 is defined by the recess 17 and the seal 16, and one opening at one end of the recess is formed as the oil outlet 132 of the oil outlet channel 13, and the other opening at the other end of the openings of the recess is formed as the oil inlet 131 of the oil outlet channel 13. In this way, by attaching the seal 16 with the end surface of the stationary scroll disk 15, the seal 16 is connected to the end surface of the stationary scroll disk 15 in a sealing manner, and an end surface of a wall of the recess 17 is abutted against the seal 16, so that the oil outlet channel 13 is formed in the housing 10. Therefore, the oil outlet channel 13 can be simply arranged.

In some embodiments, the above-mentioned recess 17 may also be formed on the seal 16. That is, the end surface of the seal 16 facing away from the oil separation structure 100 has a recess 17 defined, and the recess has two openings defined at two ends thereof. The oil outlet channel 13 is defined by the recess 17 and the end surface of the stationary scroll disk 15, and the openings defined at two ends of the recess 17 are formed as the oil outlet 132 and the oil inlet 131 of the oil outlet channel 13, respectively. In this way, by attaching the seal 16 to the end surface of the stationary scroll disk 15, the seal 16 is connected to the end surface of the stationary scroll disk 15 in a sealing manner, and the end surface of the wall of the recess 17 is abutted against the seal 16, so that the oil outlet channel 13 can be also formed in the housing 10.

In this embodiment, the seal 16 may be, but is not limited to, a sealing gasket or the like that is sealingly attached to the side wall surface of the stationary scroll disk 15.

It should be noted that, in the above two embodiments, the oil return hole 121 and the vent hole 122 both penetrate the seal 16 to prevent the arrangement of the seal 16 from affecting the normal discharge of the refrigeration oil and the refrigerant.

In another embodiment of the present disclosure, as another alternative to the above-mentioned embodiments, as shown in FIG. 4, the housing 10 of the scroll compressor includes an oil separation shell 101 having a connection surface 1011. The connection surface matches with and is connected to the end surface of the stationary scroll disk 15 facing towards the oil separation structure 100. Here, the matching connection between the connection surface 1011 and the end surface of the stationary scroll disk 15 means that a shape of the connection surface 1011 is the same as or similar to that of the end surface of the stationary scroll disk 15, and a size of the connection surface 1011 is substantially the same as that of the end surface of the stationary scroll disk 15. Further, the connection surface 1011 has a recess defined thereon, and the recess has openings defined at two ends thereof. In some embodiments, the recess 17 is recessed away from the stationary scroll disk 15 on the connection surface 1011. The end surface of the stationary scroll disk 15 is attached to the connection surface 1011, and the above-mentioned oil outlet channel 13 is defined by the end surface of the stationary scroll disk 15 and the recess 17. One opening at one end of the recess 17 is formed as the oil outlet 132 of the above oil outlet channel 13, and the other opening at the other end of the recess 17 is formed as the oil inlet 131 of the above oil outlet channel 13. By forming the recess 17 on the connection surface 1011 of the oil separation shell 101, when the connection surface 1011 of the oil separation shell 101 is attached to the end surface of the stationary scroll disk 15, an end surface of a wall of the recess 17 is abutted against the end surface of the stationary scroll disk 15 to form the above oil outlet channel 13. Thus, the oil outlet channel 13 can also be relatively simply arranged.

In the present embodiment, as shown in FIG. 4, the oil separation shell 101 also has an accommodation groove 1012 provided therein, and the accommodation groove 1012 is configured to accommodate the recess 17. The oil storage tank 12 as described above is defined by an inner wall surface of the accommodation groove 1012 and an outer wall surface the recess 17. The oil return hole 121 and the vent hole 122 are both defined on the oil separation shell 101. In this way, by providing a separate oil separation shell 101 for arranging the oil outlet channel 13 as described above, the oil separation shell 101 is independently formed and arranged, which is more convenient for disassembly and assembly, and more convenient for maintenance and repairing of the oil outlet channel 13, the oil storage tank 12, the vent hole 122, and the like.

In this embodiment, as shown in FIG. 4, the oil separation shell 101 also has a connection channel 1013 defined therein, and the connection channel 1013 is configured to allow the precipitated refrigerant to flow therethrough. The connection channel 1013 has an inlet connected to the oil outlet 132, and an outlet connected to the vent hole 122. The refrigerant discharged from the oil outlet 132 of the oil outlet channel 13 flows through the connection channel 1013 and then is discharged through the vent hole 122. The arrangement of the connection channel 1013, on the one hand, can increase a distance between the vent hole 122 and the oil outlet 132 of the oil outlet channel 13, so as to prevent the refrigeration oil discharged from the oil outlet 132 from breaking into the vent hole 122. On the other hand, a wall of the connection channel 1013 is in communication with the wall of the oil storage tank 12, and thus the precipitated refrigerant is in contact with the wall of the connection channel 1013. Thus, the connection channel 1013 can further cool the precipitated refrigerant, so that a gaseous refrigeration oil mixed in the refrigerant is condensed on a wall surface of the channel and backflows into the oil storage tank 12, thereby better preventing the refrigeration oil from being discharged together with the refrigerant.

In this embodiment, as shown in FIG. 4, the wall surface of the connection channel 1013 has an oil blocking portion 1014 provided thereon, and the oil blocking portion 1014 is configured to block the refrigeration oil flowing out of the oil outlet 132 from flowing into the vent hole 122 through the connection channel 1013. In this embodiment, the oil blocking portion 1014 is disposed close to the oil outlet 132, and a gap is formed between the oil blocking portion 1014 and the end surface of the oil outlet 132, so as to ensure that the refrigeration oil flowing out of the oil outlet 132 can be discharged smoothly. In this way, the oil blocking portion 1014 can effectively block the refrigeration oil from entering the connection channel 1013, and both the refrigeration oil and the precipitated refrigerant can be discharged normally through the gap between the oil blocking portion 1014 and the end surface of the oil outlet 132. In this way, by providing the oil blocking portion 1014, it is possible to effectively block the refrigeration oil from entering the vent hole 122 without blocking the normal discharge of the refrigeration oil and refrigerant.

Further, in this embodiment, an oil blocking surface 1015 is formed on a side of the oil blocking portion 1014 facing towards the oil outlet 132, and the oil blocking surface 1015 is spaced apart from the end surface of the oil outlet 132. That is, it is ensured that a gap is formed between the oil blocking portion 1014 and the end surface of the oil outlet 132. In some embodiments, the oil outlet 132 may be partially or completely blocked by the oil blocking surface 1015 to ensure that the refrigeration oil discharged from the oil outlet 132 can backflow into the oil storage tank 12 after hitting the oil blocking surface 1015.

Further, in this embodiment, the oil blocking portion 1014 is a rib-like structure integrally formed on the wall of the connection channel 1013.

In this embodiment, as shown in FIG. 4, the oil separation structure 100 as described above includes an oil separation chamber 1016 arranged in the oil separation shell 101, and the oil discharging hole 1017 and the refrigerant outlet 14 are both arranged on a wall of the oil separation chamber 1016. In this way, the oil discharging hole 1017 is in communication with the first communication slot 151, and the refrigeration oil discharged from the oil discharging hole 1017 can enter the oil inlet 131 of the oil outlet channel 13 through the first communication slot 151.

Further, the wall of the oil separation chamber 1016 also has an oil separation inlet 1019 defined thereon and connected to the mixed fluid outlet 153 defined on the stationary scroll disk 15, for allowing a mixed fluid of the refrigerant and the refrigeration oil discharged from the compression chamber 30 of the scroll compressor to enter the oil separation chamber 1016 to be processed through an oil separation process. In this embodiment, the flow path of the mixed fluid is shown by the dotted-line arrow in FIG. 4. In this way, the mixed fluid discharged from the mixed fluid outlet 153 of the stationary scroll disk 15 directly enters the oil separation chamber 1016. The resulted separated refrigeration oil enters the oil inlet 131 of the oil outlet channel 13 through the oil discharging hole 1017, and the resulted separated refrigerant is discharged through the refrigerant outlet 14.

In another embodiment of the present disclosure, as shown in FIGS. 2, 3 and 4, the oil separation structure 100 as described above also includes an oil separation tube 11 disposed in the oil separation chamber 1016, and the oil separation tube 11 has an intake end 111 and an outtake end 112. The intake end 111 of the oil separation tube 11 is arranged towards a side where the oil discharging hole 1017 is located, and the outtake end 112 of the oil separation tube 11 is in communication with the refrigerant outlet 14. The mixed fluid flows spirally after entering the oil separation chamber 1016 from the oil separation inlet 1019 and collides with the wall of the oil separation chamber 1016 and the oil separation tube 11, thereby achieving the separation of the refrigerant and the refrigeration oil.

Further, in this embodiment, a flow area S1 of the refrigerant outlet 14 as described above, a flow area S2 of the intake end 111 of the oil separation tube 11, and a flow area S3 of the oil discharging hole 1017 satisfy a ratio relationship: $0.05 \leq S2/S1 \leq 0.5$, $0.02 \leq S3/S1 \leq 0.3$. By setting the flow area S1 of the refrigerant outlet 14, the flow area S2 of the intake end 111 of the oil separation tube 11, and the flow area S3 of the oil discharging hole 1017 to satisfy the ratio relationship of $0.05 \leq S2/S1 \leq 0.5$ and $0.02 \leq S3/S1 \leq 0.3$, the ratio of the flow area S2 of the intake end 111 of the oil separation tube 11 to the flow area S1 of the refrigerant outlet 14 is defined in a range of 0.05~0.5, and the ratio of the flow area S3 of the oil discharging hole 1017 to the flow area S1 of the refrigerant outlet 14 is defined in a range of 0.02 to 0.3. In this way, the flow area of the refrigerant outlet 14 is greater than that of the intake end 111 of the oil separation tube 11, and the flow area of the refrigerant outlet 14 is greater than that of the oil discharging hole 1017, so that the separated refrigerant can be discharged through the refrigerant outlet 14 at a higher velocity, so as to reduce a pressure in the oil separation chamber 1016 in time and a pressure on the refrigeration oil discharged through the oil discharging hole 1017, thereby reducing the flow rate of the refrigeration oil discharged from the oil discharging hole 1017 to better ensure that the refrigeration oil in the oil storage tank 12 is always submerged in the oil return hole 121.

In some embodiments, the ratio between the flow area S2 of the intake end 111 of the oil separation tube 11 and the flow area S1 of the refrigerant outlet 14 as described above, i.e., S2/S1, may be 0.05, 0.1, 0.2, 0.3, 0.4 or 0.5, etc. The ratio between the flow area S3 of the oil discharging hole 1017 and the flow area S1 of the refrigerant outlet 14 as described above, i.e., S3/S1, may be 0.02, 0.05, 0.08, 0.1, 0.15, 0.2, 0.25 or 0.3 etc.

Figure 8:
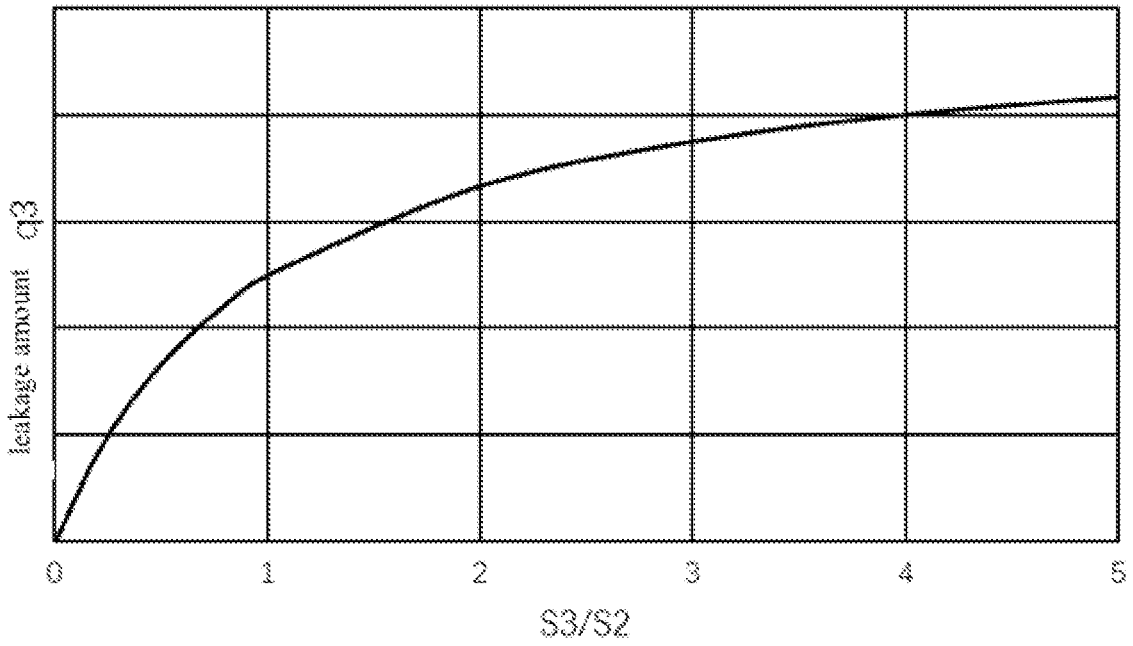
FIG. 8 is a relationship diagram between S3/S2 and a leakage amount.

Further, in this embodiment, as shown in FIG. 2, FIG. 3 and FIG. 4, the flow area S2 of the intake end 111 of the oil separation tube 11 and the flow area S3 of the oil discharging hole 1017 satisfy the ratio relationship of $0.08 \leq S3/S2 \leq 0.8$. That is, the ratio of the flow area S3 of the oil discharging hole 1017 to the flow area S2 of the intake end 111 of the oil separation tube 11 is defined in a range of 0.08 to 0.8. In some embodiments, as shown in FIG. 8, a relationship between S3/S2 and a leakage amount $q^3$ (i.e., an amount of the refrigerant leaked into the oil return channel 20 of the scroll compressor through the oil return hole 121) is shown. As can be seen from FIG. 8, the leakage amount gradually increases as S3/S2 increases. Thus, when considering manufacturing errors of the parts, the ratio of S3 to S2 is selected within the range of 0.08~0.8, and thus the leakage amount is relatively small, which will not adversely affect the return volume of the refrigeration oil. That is, within this range, the leakage amount of the refrigerant leaked through the oil return hole 121 of the oil storage tank 12 has little effect on the proportion of the refrigeration oil in the return oil.

In some embodiments, the ratio between the flow area S3 of the oil discharging hole 1017 and the flow area S2 of the intake end 111 of the oil separation tube 11, i.e., S3/S2, may be 0.08, 0.1, 0.2, 0.3, 0.4, 0.5, 0.6, 0.7 or 0.8, etc.

In another embodiment of the present disclosure, as shown in FIG. 2, FIG. 3 and FIG. 4, a flow area S4 of the oil outlet 132 of the oil outlet channel 13 and the flow area S3 of the oil discharging hole 1017 satisfy a ratio relationship of $1 \leq S4/S3 \leq 7$ That is, the ratio of the flow area S4 of the oil outlet 132 of the oil outlet channel 13 to the flow area S3 of the oil discharging hole 1017 is defined within the range of 1 to 7. In this way, the overflow area S4 of the oil outlet 132 of the oil outlet channel 13 is greater than the overflow area S3 of the oil discharging hole 1017. Therefore, when the refrigeration oil flows out of the oil outlet 132, the flow area sharply increases, and the flow velocity is further slowed down, which further reduces the impact of the refrigeration oil discharged from the oil outlet 132 on the level of the refrigeration oil in the oil storage tank 12.

Figure 9:
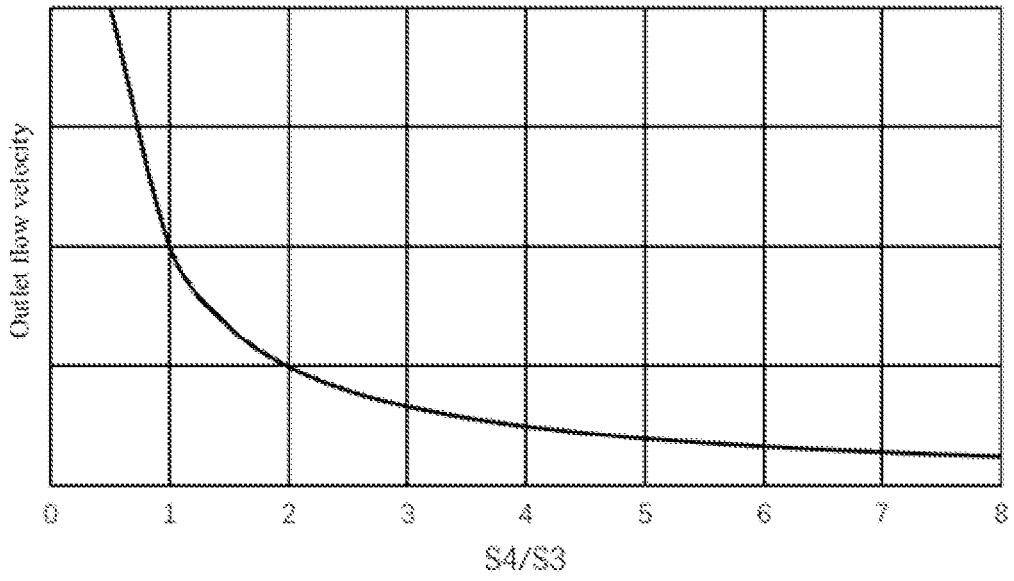
FIG. 9 is a relationship diagram between S4/S3 and an outlet flow velocity when a refrigeration oil flows out of an oil outlet.

In some embodiments, as shown in FIG. 9, a relationship between S4/S3 and the outlet flow velocity of the refrigeration oil when flowing out of the oil outlet 132 is shown. As can be seen from FIG. 9, as S4/S3 increases, the outlet flow velocity gradually decreases. In this way, when considering the manufacturing errors of the parts, the ratio of S4 to S3 is selected within the range of 1 to 7, and the flow velocity of the refrigeration oil flowing out of the oil outlet 132 of the oil outlet channel 13 is relatively small, which will not adversely affect the return volume of the refrigeration oil. That is, within this range, the leakage amount of the refrigerate leaked through the oil return hole 121 of the oil storage tank 12 has little effect on the proportion of the refrigeration oil in the return oil.

In some embodiments, the ratio between the flow area S4 of the oil outlet 132 of the oil outlet channel 13 and the flow area S3 of the oil discharging hole 1017 as described above, i.e., S4/S3, may be 1, 2, 3, 4, 0.4, 5, 6 or 7 etc.

Figure 10:
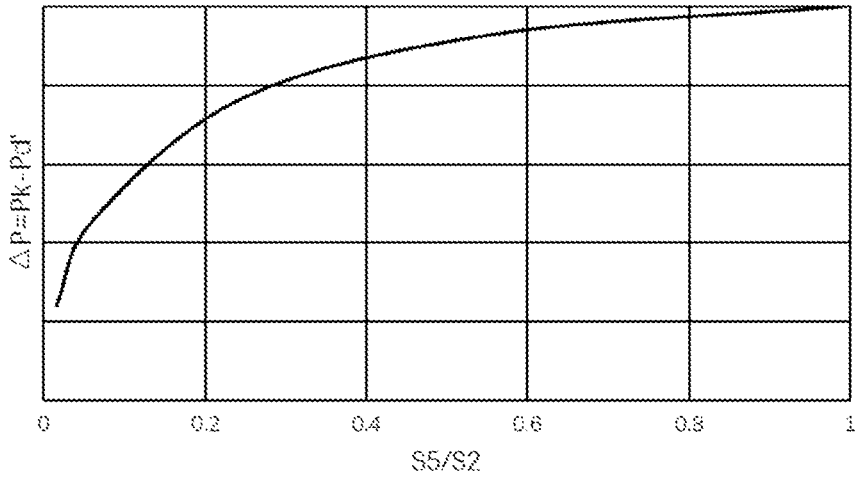
FIG. 10 is a relationship diagram between S5/S2 and a pressure difference ΔP between an oil outlet and an oil inlet of an oil outlet channel.

In another embodiment of the present disclosure, as shown in FIG. 2, FIG. 3 and FIG. 4, a flow area S5 of the vent hole 122 and the flow area S2 of the intake end 111 of the oil separation tube 11 satisfy a ration relationship of $0.015 \leq S5/S2 \leq 1$. That is, the ratio of the flow area S5 of the vent hole 122 to the flow area S2 of the intake end 111 of the oil separation tube 11 is defined within a range of 0.015 to 1. In some embodiments, as shown in FIG. 10, a relationship between S5/S2 and Pk−Pd' (a pressure difference ΔP between the oil outlet 132 and the oil inlet 131 of the oil outlet channel 13) is shown. As can be seen from FIG. 10, values of S5/S2 within a range of 0.015~1 all satisfy that the pressure difference ΔP is greater than zero. That is, it can be ensured that the refrigerant precipitated from the refrigeration oil is discharged through the vent hole 122 by means of the pressure. In addition, since the higher the pressure difference ΔP is, the faster the flow velocity of the refrigeration oil in the oil outlet channel 13 is. Therefore, if the pressure difference ΔP satisfies the requirement of the refrigerant discharging, it is avoided to set the ratio of S5/S2 to be too large, so as to prevent the refrigeration oil in oil outlet channel 13 from accelerating the flowing by an excessive pressure, to ensure that the refrigeration oil can flow and slow down along the oil outlet channel 13, thereby ensuring an oil output stability of the oil outlet channel 13. In addition, selecting the ratio of S5/S2 within the above range can avoid overflowing from the oil outlet 132 of the oil outlet channel 13 through the vent hole 122 due to too large diameter of the vent hole 122.

In some embodiments, the ratio between the flow area S5 of the vent hole 122 and the flow area S2 of the intake end 111 of the oil separation tube 11 (i.e., S5/S2) may be 0.015, 0.01, 0.02, 0.03, 0.04, 0.05, 0.06, 0.07, 0.08 or 1.0, etc.

In another embodiment of the present disclosure, as shown in FIG. 2, FIG. 3 and FIG. 4, the oil separation shell 101 also has a rectification chamber 1018 provided therein, and the rectification chamber 1018 is arranged close to the oil separation chamber 1016. The rectification chamber 1018 is configured to perform a first-stage depressurization and deceleration processing on the mixed fluid of the refrigerant and the refrigeration oil before the mixed fluid enters the oil separation chamber 1016. In this embodiment, a mixed fluid inlet 1020 communicates the mixed fluid outlet 153 on the stationary scroll disk 15 with the rectification chamber 1018, so that the mixed fluid discharged from the compression chamber 30 is introduced into the rectification chamber 1018. The mixed fluid discharged from the compression chamber 30 enters the rectification chamber 1018 through the mixed fluid inlet 1020, and then enters the oil separation chamber 1016 through the oil separation inlet 1019 for the oil-gas separation after discharged from the rectification chamber 1018. In some embodiments, when the rectification chamber 1018 is provided, the flow paths of the mixed fluid are shown by the dotted arrows in FIGS. 2 and 4.

In this embodiment, the oil separation inlet 1019 is disposed above the mixed fluid inlet 1020 in the direction of gravity, so as to avoid the mixed fluid entering the rectification chamber 1018 from the oil separation inlet 1019 from directly entering the oil separation chamber 1016 through the oil separation inlet 1019 without flowing in the rectification chamber 1018, i.e., so as to avoid short-flow of the mixed fluid, thereby ensuring that the rectification chamber 1018 can reliably and effectively rectify and depressurize the mixed fluid. When in use, the mixed fluid inlet 1020 formed on the oil separation shell 101 is connected to the mixed fluid outlet 153 formed on the stationary scroll disk 15, so that the mixed fluid of the refrigerant and the refrigeration oil discharged from the compression chamber 30 of the scroll compressor enters the rectification chamber 1018 through the mixed fluid inlet 1020, and the rectification chamber 1018 can rectify the discharged mixed fluid to reduce the flow rate of the mixed fluid and a pressure pulsation, thereby realizing the first-stage depressurization of the mixed fluid. In this way, when the mixed fluid rectified by the rectification chamber 1018 enters the oil separation chamber 1016 for the oil separation processing, the pressure of the mixed fluid is greatly reduced via the first-stage depressurization. When the mixed fluid collides with the wall of the oil separation chamber 1016 and the oil separation tube 11, since the pressure of the mixed fluid is greatly reduced, the pressure pulsation of the mixed fluid is weakened, and the flow rate is reduced. Therefore, the impact of the mixed fluid on the wall of the oil separation chamber 1016 and the oil separation tube 11 is reduced, and an impact noise is reduced, thereby reducing an impact loss of the oil separation tube 11 and prolonging the service life.

Further, in this embodiment, as shown in FIG. 4, the rectification chamber 1018 is a chamber having a streamlined wall surface 1021. In some embodiments, the streamlined wall surface 1021 is disposed on a side of the mixed fluid inlet 1020, and the mixed fluid flowing through the mixed fluid inlet 1020 flows in the rectification chamber 1018 by a guidance of the streamlined wall surface 1021. In this way, the mixed fluid flows along the streamlined wall surface 1021, and the fluid thus flows more smoothly, thereby further reducing the impact of the mixed fluid on an inner wall surface of the rectification chamber 1018 and improving noise reduction effect of the rectification chamber 1018 more effectively.

Further, in this embodiment, as shown in FIGS. 5 and 6, when the scroll compressor is provided with the seal 16, a position where the seal 16 faces towards the mixed fluid inlet 1020 is hollowed, so that an avoidance position 161 for avoiding the mixed fluid inlet 1020 is formed at the position where the seal 16 faces towards the mixed fluid inlet 1020. Thus, it can be ensured that the discharging of the mixed fluid will not be blocked by the seal 16 and that the mixed fluid can be discharged into the rectification chamber 1018 through the mixed fluid inlet 1020.

In another embodiment of the present disclosure, the oil separation shell 101 as described above and the seal 16 are both made of a material with strong impact resistance, so as to ensure that the oil separation shell 101 and the seal 16 will not be deformed due to the impact of the mixed fluid, the refrigerant or the refrigeration oil, thereby prolonging the service life of the oil separation shell 101 and the seal 16.

In another embodiment of the present disclosure, the refrigerant outlet 14 as described above is formed as a flaring port. That is, a flow area of the refrigerant outlet 14 gradually increases in the flowing direction of the refrigerant, so that at least a part of the refrigerant outlet 14 is formed into a flaring shape. The flow rate gradually decreases when the refrigerant flows in the refrigerant outlet 14. In this way, a gas flow can be decelerated and depressurized at the refrigerant outlet 14, which can provide the rectification to a certain extent, thereby providing more stable refrigerant discharging. Therefore, an impact on the housing 10 is reduced during discharging the refrigerant through the refrigerant outlet 14.

It should be noted that, in the embodiment of the present disclosure, when the refrigerant outlet 14 is formed as the flaring port, the flow area S1 of the refrigerant outlet 14 as described above refers to a flow area of the inlet end of the refrigerant outlet 14.

Other embodiments of the present disclosure also provide a refrigeration device (not shown) including the scroll compressor as described.

In the refrigeration device according to the embodiments of the present disclosure, by employing the scroll compressor as described above, since the oil outlet channel 13 is disposed in the housing 10 of the scroll compressor, and the oil outlet channel 13 can guide the refrigeration oil to flow against the direction of gravity, it is possible to reduce the outflow velocity and the outflow pressure when the refrigeration oil is discharged into the oil storage tank 12 and the impact on the refrigeration oil in the oil storage tank 12 when the refrigeration oil is discharged, thereby ensuring that the refrigeration oil in the oil storage tank 12 remains stable to increase the effective oil storage volume of the oil storage tank 12. In addition, the oil return hole 121 of the oil storage tank 12 is always submerged by the refrigeration oil, which preventing the refrigerant from leaking directly into the oil return channel 20 of the scroll compressor through the oil return hole 121. Therefore, the scroll compressor has sufficient oil return and improved compression efficiency, thereby optimizing refrigeration capacity of the refrigeration device.

Other embodiments of the present disclosure also provide a vehicle including the refrigeration device as described above.

In the vehicle according to the embodiments of the present disclosure, by employing the refrigeration device as described above, during refrigeration of the vehicle, since the refrigeration capacity and the refrigeration efficiency of the refrigeration device can always be maintained at a higher level, the cooling time inside the vehicle can be effectively shortened, and the cooling speed of the vehicle is boosted, thereby improving vehicle use experience.

It should be noted that, in this embodiment, the specific types of the above vehicles are not limited. For example, the vehicle may be a traditional fuel vehicle or a new energy vehicle. The new energy vehicle herein includes, but is not limited to, a pure electric vehicle, an extended-range electric vehicle, a hybrid electric vehicle, a fuel cell electric vehicle, a hydrogen engine vehicle, and the like, which is not particularly limited herein.

The above embodiments are merely preferred embodiments of the present disclosure, and are not intended to limit the present disclosure. Various changes, equivalent alternatives and modifications can be made by those skilled in the art. Any changes, equivalent alternatives and modifications made in the spirit and principle of the present disclosure should fall within the scope of present disclosure.

What is claimed is:

1. A scroll compressor comprising:

a housing, an oil separation structure provided in the housing, an oil storage tank provided in the housing, and an oil outlet channel provided in the housing, wherein:

the oil outlet channel has an oil inlet and an oil outlet located above the oil inlet, the oil inlet is in communication with an oil discharging hole of the oil separation structure, the oil separation structure is above the oil inlet and the oil discharging hole, and the oil outlet being within the oil storage tank and above an oil level of the oil storage tank.

2. The scroll compressor according to claim 1, wherein:

a refrigerant outlet is defined in the housing, and the oil storage tank has a vent hole defined on a wall of the oil storage tank and the vent hole is in communication with the refrigerant outlet.

3. The scroll compressor according to claim 2, further comprising a stationary scroll disk, wherein a side wall of the stationary scroll disk facing towards the oil separation structure has a first communication slot and a second communication slot, wherein the oil discharging hole is connected to the oil inlet by the first communication slot, and wherein the vent hole is connected to the refrigerant outlet by the second communication slot.

4. The scroll compressor according to claim 3, further comprising a seal attached to an end surface of the stationary scroll disk facing towards the oil separation structure, wherein the end surface of the stationary scroll disk facing towards the oil separation structure has a recess defined in the end surface, wherein the recess has openings defined at two ends of the recess and formed as the oil outlet and the oil inlet, respectively, and wherein the oil outlet channel is defined by the recess and the seal.

5. The scroll compressor according to claim 3, further comprising a seal attached to an end surface of the stationary scroll disk facing towards the oil separation structure, wherein an end surface of the stationary scroll disk facing away from the oil separation structure has a recess defined in the end surface, wherein the recess has openings defined at two ends of the recess and formed as the oil outlet and the oil inlet, respectively, and wherein the oil outlet channel is defined by the recess and the end surface of the stationary scroll disk.

6. The scroll compressor according to claim 3, wherein:

the housing comprises an oil separation shell having a connection surface, wherein the connection surface matches with and is connected to an end surface of the stationary scroll disk facing towards the oil separation structure, the connection surface has a recess defined in the connection surface, the recess having openings defined at two ends of the recess and formed as the oil outlet and the oil inlet, respectively, the end surface of the stationary scroll disk is attached to the connection surface, and the oil outlet channel is defined by the end surface of the stationary scroll disk and the recess.

7. The scroll compressor according to claim 6, wherein:
the oil separation shell further has an accommodation groove provided in the oil separation shell and configured to accommodate the recess, and
the oil storage tank is defined by an inner wall surface of the accommodation groove and an outer wall surface the recess.

8. The scroll compressor according to claim 7, wherein:
the oil separation shell further has a connection channel defined in the oil separation shell, the connection channel being configured to allow a precipitated refrigerant to flow through the connection channel, and
the connection channel has an inlet connected to the oil outlet, an outlet connected to the vent hole, and a wall connected to the wall of the oil storage tank.

9. The scroll compressor according to claim 8, wherein:
the wall of the connection channel has an oil blocking portion provided on the wall, and
a gap is formed between the oil blocking portion and an end surface of the oil outlet.

10. The scroll compressor according to claim 6, wherein:
the oil separation structure comprises an oil separation cavity disposed in the oil separation shell, the oil discharging hole and the refrigerant outlet being arranged on a wall of the oil separation cavity;
the wall of the oil separation cavity further has an oil separation inlet defined in the wall; and
the stationary scroll disk has a mixed fluid outlet defined in the stationary scroll disk and in communication with the oil separation inlet.

11. The scroll compressor according to claim 1, wherein the oil outlet channel has a flow area gradually increasing in a direction from the oil inlet to the oil outlet.

12. The scroll compressor according to claim 1, wherein the oil outlet channel is a curved channel having at least one curved section.

13. The scroll compressor according to claim 1, wherein:
the oil storage tank has a plurality of ribs provided on a wall of the oil storage tank and arranged at intervals, and
each of the plurality of ribs has one end facing towards a top of the oil storage tank and another end facing towards a bottom of the oil storage tank.

14. The scroll compressor according to claim 1, wherein the oil outlet is arranged away from a bottom of the oil storage tank.

15. The scroll compressor according to claim 1, wherein:
the oil outlet channel comprises an oil outlet pipe comprising an introduction section and a discharging section connected to the introduction section;
a port of the introduction section facing away from the discharging section is formed as the oil inlet; and
a port of the discharging section facing away from the introduction section is formed as the oil outlet.

16. The scroll compressor according to claim 1, wherein:
at least a portion of the oil outlet channel is within the oil storage tank.

17. A refrigeration device comprising:
a scroll compressor comprising:
a housing,
an oil separation structure provided in the housing,
an oil storage tank provided in the housing, and
an oil outlet channel provided in the housing,
wherein:
the oil outlet channel has an oil inlet and an oil outlet located above the oil inlet,
the oil inlet is in communication with an oil discharging hole of the oil separation structure,
the oil separation structure is above the oil inlet and the oil discharging hole, and
the oil outlet being within the oil storage tank and above an oil level of the oil storage tank.

18. A vehicle comprising:
a refrigeration device comprising:
a scroll compressor comprising:
a housing,
an oil separation structure provided in the housing,
an oil storage tank provided in the housing, and
an oil outlet channel provided in the housing,
wherein:
the oil outlet channel has an oil inlet and an oil outlet located above the oil inlet, the oil inlet is in communication with an oil discharging hole of the oil separation structure,
the oil separation structure is above the oil inlet and the oil discharging hole, and
the oil outlet being within the oil storage tank and above an oil level of the oil storage tank.

* * * * *